US008596365B2

(12) United States Patent
Frosell

(10) Patent No.: US 8,596,365 B2
(45) Date of Patent: Dec. 3, 2013

(54) RESETTABLE PRESSURE CYCLE-OPERATED PRODUCTION VALVE AND METHOD

(75) Inventor: Thomas Frosell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 230 days.

(21) Appl. No.: 13/021,501

(22) Filed: Feb. 4, 2011

(65) Prior Publication Data

US 2012/0199364 A1 Aug. 9, 2012

(51) Int. Cl.
*E21B 34/10* (2006.01)

(52) U.S. Cl.
USPC ..... 166/321; 166/373; 166/374; 166/331; 166/332.1

(58) Field of Classification Search
USPC ..... 166/240, 373, 374, 321, 331, 332.1, 166/334.1; 251/230; 137/512
See application file for complete search history.

(56) References Cited

U.S. PATENT DOCUMENTS

| | | | | |
|---|---|---|---|---|
| 3,990,511 | A | 11/1976 | Gazda | |
| 4,475,599 | A | 10/1984 | Akkerman | |
| 6,173,795 | B1 | 1/2001 | McGarian et al. | |
| 6,230,807 | B1 | 5/2001 | Patel | |
| 6,241,015 | B1 | 6/2001 | Pringle et al. | |
| 6,397,949 | B1 | 6/2002 | Walker et al. | |
| 6,644,412 | B2 | 11/2003 | Bode et al. | |
| 6,684,950 | B2 | 2/2004 | Patel | |
| 7,210,534 | B2 | 5/2007 | Hayter et al. | |
| 2001/0042626 | A1 | 11/2001 | Patel | |
| 2002/0066573 | A1 | 6/2002 | Patel | |
| 2002/0112862 | A1 * | 8/2002 | Patel | 166/386 |
| 2007/0251697 | A1 * | 11/2007 | Loretz et al. | 166/374 |
| 2009/0272539 | A1 | 11/2009 | Lloyd et al. | |
| 2011/0100643 | A1 | 5/2011 | Themig et al. | |
| 2012/0199364 | A1 | 8/2012 | Frosell | |

FOREIGN PATENT DOCUMENTS

| | | | |
|---|---|---|---|
| WO | 2009132462 | A1 | 11/2009 |
| WO | WO 2010127457 | A1 * | 11/2010 |

OTHER PUBLICATIONS

Search Report issued Aug. 7, 2012 for International Application No. PCT/US12/21949, 5 pages.
Written Opinion issued Aug. 7, 2012 for International Application No. PCT/US12/21949, 4 pages.
International Search Report with Written Opinion issued Aug. 7, 2012 for PCT Application No. PCT/US12/023321, 9 pages.

(Continued)

*Primary Examiner* — David Bagnell
*Assistant Examiner* — Richard Alker
(74) *Attorney, Agent, or Firm* — Smith IP Services, P.C.

(57) ABSTRACT

A method of actuating multiple valves in a well can include applying one or more pressure cycles to the valves without causing actuation of any of the valves, and then reducing pressure applied to the valves, thereby resetting a pressure cycle-responsive actuator of each valve. A pressure cycle-operated valve for use in a well can include a closure member, a piston which displaces in response to pressure applied to the valve, and a ratchet mechanism which controls relative displacement between the piston and the closure member. The ratchet mechanism may permit relative displacement while one or more pressure cycles are applied to the valve, and the ratchet mechanism may prevent relative displacement in response to a pressure sequence of: a) a reduction in pressure applied to the valve, b) a predetermined number of pressure cycles applied to the valve, and c) an increase in pressure applied to the valve.

9 Claims, 8 Drawing Sheets

(56) References Cited

OTHER PUBLICATIONS

Patent Application, filed Feb. 21, 2011 and assigned U.S. Appl. No. 13/031,551, 27 pages.
Drawings, filed Feb. 21, 2011 and assigned U.S. Appl. No. 13/031,551, 8 pages.
Halliburton, "OMNI Single-Trip Circulating Valve", Product brochure H04996, dated Dec. 2009, 2 pages.
Halliburton, "ESTMZ Enhanced Single-Trip Multizone System", Product brochure H06382, dated Jun. 2009, 3 pages.
Office Action issued Nov. 23, 2012 for U.S. Appl. No. 13/031,551, 17 pages.
Office Action issued Mar. 14, 2013 for U.S. Appl. No. 13/719,944, 18 pages.
Office Action issued Apr. 25, 2013 for U.S. Appl. No. 13/031,551, 14 pages.
Office Action issued Aug. 20, 2013 for U.S. Appl. No. 13/719,944, 13 pages.
Office Action issued Sep. 17, 2013 for U.S. Appl. No. 13/031,551, 12 pages.

* cited by examiner

RESETTABLE PRESSURE CYCLE-OPERATED PRODUCTION VALVE AND METHOD

BACKGROUND

This disclosure relates generally to equipment utilized and procedures performed in conjunction with a subterranean well and, in an example described below, more particularly provides a resettable pressure cycle-operated production valve.

Pressure-operated valves used in downhole environments have an advantage, in that they can be operated remotely, that is, without intervention into a well with a wireline, slickline, coiled tubing, etc. However, a conventional pressure-operated valve can also respond to applications of pressure which are not intended for operation of the valve, and so it is possible that the valve can be operated inadvertently.

Therefore, it will be appreciated that it would be desirable to prevent inadvertent operation of a pressure cycle-operated valve.

SUMMARY

In the disclosure below, a well system, method and valve are provided which bring improvements to the art of operating valves in well environments. One example is described below in which the valve can be reset after pressure cycles have been applied to the valve. Another example is described below in which the valve can be operated by applying a particular pressure sequence, after the valve has been reset.

In one aspect, a method of actuating multiple valves in a well is described below. The method can include applying at least one pressure cycle to the valves without causing actuation of any of the valves, and then reducing pressure applied to the valves, thereby resetting a pressure cycle-responsive actuator of each valve.

In another aspect, a pressure cycle-operated valve for use with a subterranean well is described below. The valve can include a closure member, a piston which displaces in response to pressure applied to the valve, and a ratchet mechanism which controls relative displacement between the piston and the closure member. The ratchet mechanism permits relative displacement between the piston and the closure member while at least one pressure cycle is applied to the valve, and the ratchet mechanism prevents relative displacement between the piston and the closure member in response to a pressure sequence of: a) a reduction in pressure applied to the valve, b) a predetermined number of pressure cycles applied to the valve, and c) an increase in pressure applied to the valve.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
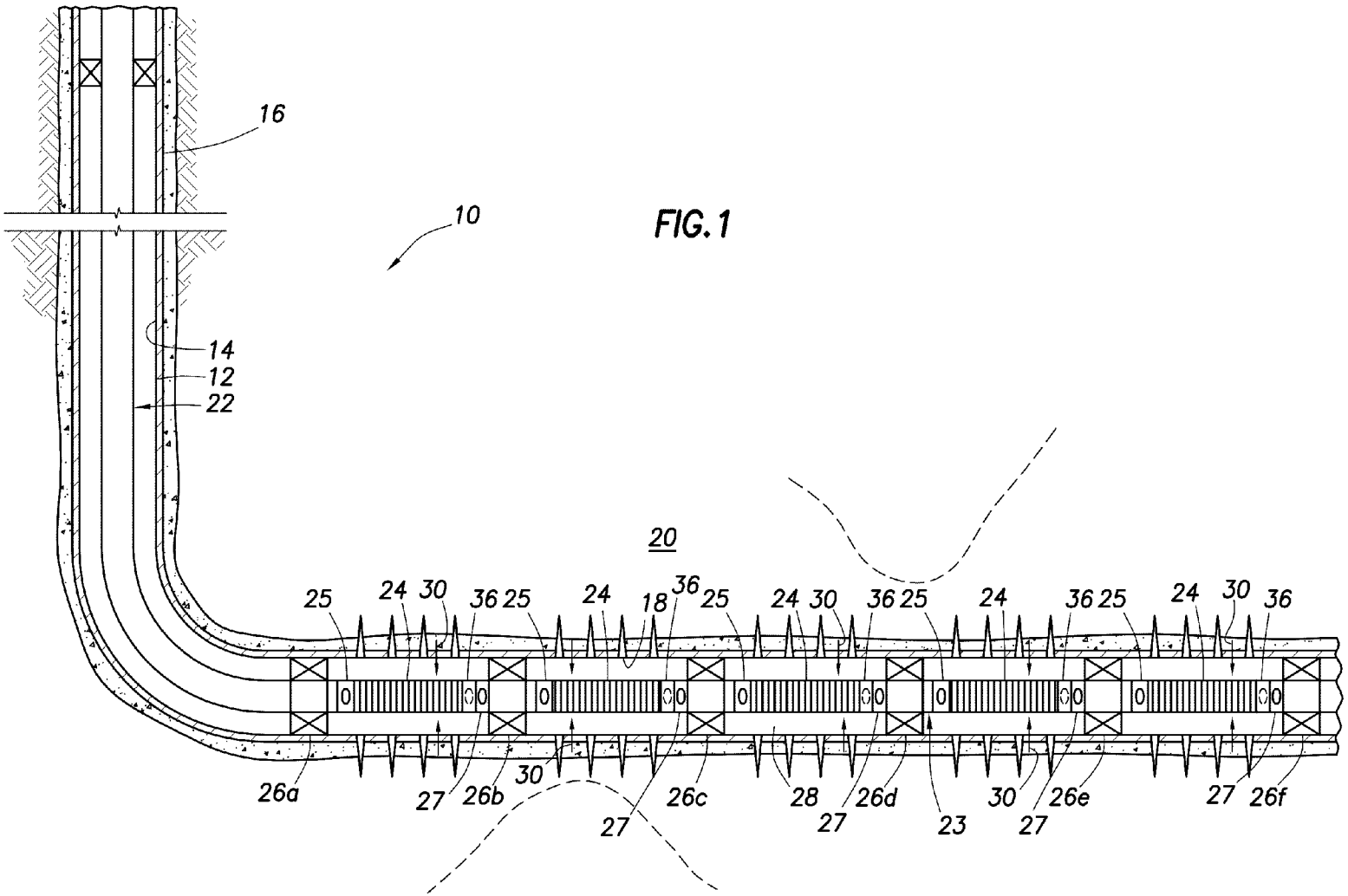
FIG. 1 is a representative partially cross-sectional view of a well system and associated method which can embody principles of the present disclosure.

Representatively illustrated in FIG. 1 is a well system 10 and associated method which can embody principles of this disclosure. In this example, a wellbore 12 has a generally vertical section 14, and a generally horizontal section 18 extending through an earth formation 20.

A tubular string 22 (such as a production tubing string, or upper completion string) is installed in the wellbore 12. The tubular string 22 is stabbed into a gravel packing packer 26*a*.

The packer 26*a* is part of a generally tubular completion string 23 which also includes multiple well screens 24, valves 25, isolation packers 26*b-e*, and a sump packer 26*f*. Valves 27 are also interconnected in the completion string 23.

The packers 26*a-f* seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26*a-f*.

Positioned between each adjacent pair of the packers 26*a-f*, at least one well screen 24 and the valves 25, 27 are interconnected in the tubular string 22. The well screen 24 filters the fluids 30 flowing into the tubular string 22 from the annulus 28.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and valves 25, 27 to be positioned between each adjacent pair of the packers 26*a-f*. It is not necessary for a single valve 25 or 27 to be used in conjunction with a single well screen 24. Any number, arrangement and/or combination of these components may be used.

It is not necessary for the well screens 24, valves 25, 27, packers 26*a-f* or any other components of the tubular string 22 to be positioned in cased sections 14, 18 of the wellbore 12. Any section of the wellbore 12 may be cased or uncased, and any portion of the tubular string 22 or completion string 23 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

The well system 10 and associated method can have components, procedures, etc., which are similar to those used in the ESTMZ™ completion system marketed by Halliburton Energy Services, Inc. of Houston, Tex. USA. In the ESTMZ™ system, the casing 16 is perforated, the formation 20 is fractured and the annulus 28 about the completion string 23 is gravel packed as follows:

a) The sump packer 26*f* is installed and set.

b) The casing 16 is perforated (e.g., using un-illustrated wireline or tubing conveyed perforating guns).

c) The completion string 23 is installed (e.g., conveyed into the wellbore 12 on a work string and service tool).

d) Internal pressure is applied to the work string to set the upper gravel packing packer 26*a*. A suitable gravel packing packer is the VERSA-TRIEVE™ packer marketed by Halliburton Energy Services, Inc., although other types of packers may be used, if desired.

e) The service tool is released from the packer 26*a*.

f) Pressure is applied to the annulus above the packer 26*a* to set all of the isolation packers 26*b-e*.

g) The service tool is displaced using the work string to open the lowest valve 27.

h) The service tool is displaced to open the next higher valve 25.

i) The service tool is displaced to a fracturing/gravel packing position.

j) Fracturing/gravel packing fluids/slurries are flowed through the work string and service tool, exiting the open valve 25. The fluids/slurries can enter the open valve 27 and flow through the service tool to the annulus 28 above the packer 26*a*.

k) The formation 20 is fractured, due to increased pressure applied while flowing the fluids/slurries.

l) The fluids/slurries are pumped until sand out, thereby gravel packing the annulus 28 about the well screen 24 between the open valves 25, 27.

m) The service tool is displaced to close the open valve 27, and excess proppant/sand/gravel is reversed out by applying pressure to the annulus above the packer 26*a*.

n) The service tool is displaced to close the open valve 25.

o) Steps g-n are repeated for each zone.

p) The work string and service tool are retrieved, and the tubular string 22 is installed.

After the last zone has been stimulated and gravel packed, it would be advantageous to be able to open multiple valves 36 to thereby permit the fluid 30 to flow through the screens 24 and into the interior of the tubular string 22 for production to the surface. It would also be advantageous to be able to do so remotely, and without the need for a physical intervention into the well with, for example, a wireline, slickline or coiled tubing to shift the valves 36.

In keeping with the principles of this disclosure, the valves 36 can be closed during the installation and fracturing/gravel packing operations, thereby preventing flow through the well screens 24 during these operations. Then, after the fracturing/gravel packing is completed and the tubular string 22 has been installed, all of the valves 36 can be opened substantially simultaneously using certain pressure manipulations described below.

It will, however, be appreciated that a number of pressure manipulations will possibly occur prior to the conclusion of the tubular string 22 installation, with the valves 36 being exposed to those pressure manipulations, and so it would be advantageous for the valves 36 to remain closed during those pressure manipulations. It is one particular benefit of the well system 10 and method of FIG. 1 that the valves 36 can remain closed while the fracturing/gravel packing and installation operations are performed, and then all of the valves 36 can be opened substantially simultaneously in response to a predefined pressure sequence.

Referring additionally now to FIGS. 2-5, a section of the completion string 23, including one example of the valve 36 which may be used in the well system 10 and method, is representatively illustrated. Of course, the completion string 23 and/or the valve 36 may be used in other well systems and methods, in keeping with the principles of this disclosure.

In this example, the valve 36 is interconnected between two of the well screens 24. Fluid 30 filtered by the screens 24 is available in respective annuli 38 at either end of the valve 36, but flow of the fluid into an interior flow passage 40 of the valve and completion string 23 is prevented by a closure member 42 in FIG. 2.

Figure 2:
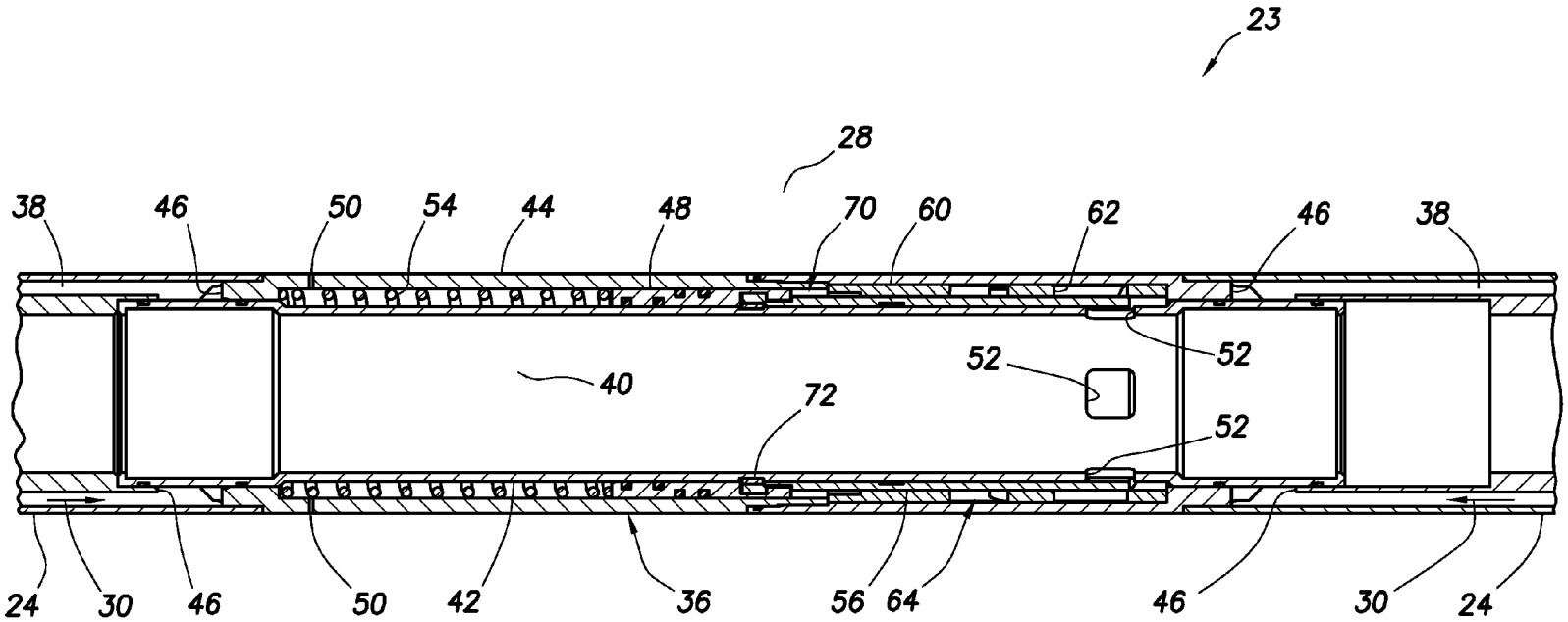
FIGS. 2-5 are representative cross-sectional views of a section of a completion string which may be used in the well system and method of FIG. 1.

As depicted in FIG. 2, the closure member 42 is in the form of a sleeve reciprocably disposed in an outer housing assembly 44, although other types of closure members (plugs, flappers, balls, etc.) could be used, if desired. The closure member 42 blocks flow through ports 46, thereby preventing communication between the annuli 38 and the flow passage 40 during the installation and fracturing/gravel packing procedures described above.

An annular piston 48 is positioned radially between the closure member 42 and the housing assembly 44. As viewed in FIG. 2, on its left-hand side the piston 48 is exposed to pressure in the annulus 28 external to the valve 36 via ports 50. On its right-hand side the piston 48 is exposed to pressure in the flow passage 40 via ports 52 formed radially through the closure member 42.

Thus, a pressure increase in the flow passage 40 (e.g., resulting in a pressure differential from the interior to the exterior of the valve 36) will bias the piston 48 leftward as viewed in FIG. 2. The piston 48 is biased rightward by a biasing device 54 (for example, a spring, compressed gas chamber, etc.). When the leftward biasing force due to the pressure increase in the flow passage 40 increases enough to overcome the rightward biasing force exerted by the biasing device 54, plus friction, the piston 48 will displace leftward from its FIG. 2 position.

In this description of the valve 36, a pressure increase is applied as a pressure differential from the interior of the valve (e.g., in the flow passage 40) to the exterior of the valve (e.g., in the annulus 28 surrounding the valve), for example, by increasing pressure in the tubular string 22. However, such a pressure differential could alternatively be applied by reducing pressure in the annulus 28.

Thus, a "pressure increase" and similar terms should be understood as a pressure differential increase, whether pressure is reduced or increased on the interior or exterior of the valve 36. A "pressure reduction" and similar terms should be understood as a pressure differential reduction, whether pressure is reduced or increased on the interior or exterior of the valve 36.

The piston 48 is connected to a sleeve 56 which is provided with a pin or lug 58 (not visible in FIG. 2, see FIG. 7) on its exterior surface. The sleeve 56 can rotate relative to the piston 48 and closure member 42 as the sleeve displaces with the piston.

A generally annular shaped J-slot sleeve 60 is positioned radially between the sleeve 56 and the housing assembly 44. As depicted in FIG. 2, the sleeve 60 has a J-slot profile 62 formed thereon which extends radially through the sleeve 60.

Figure 6:
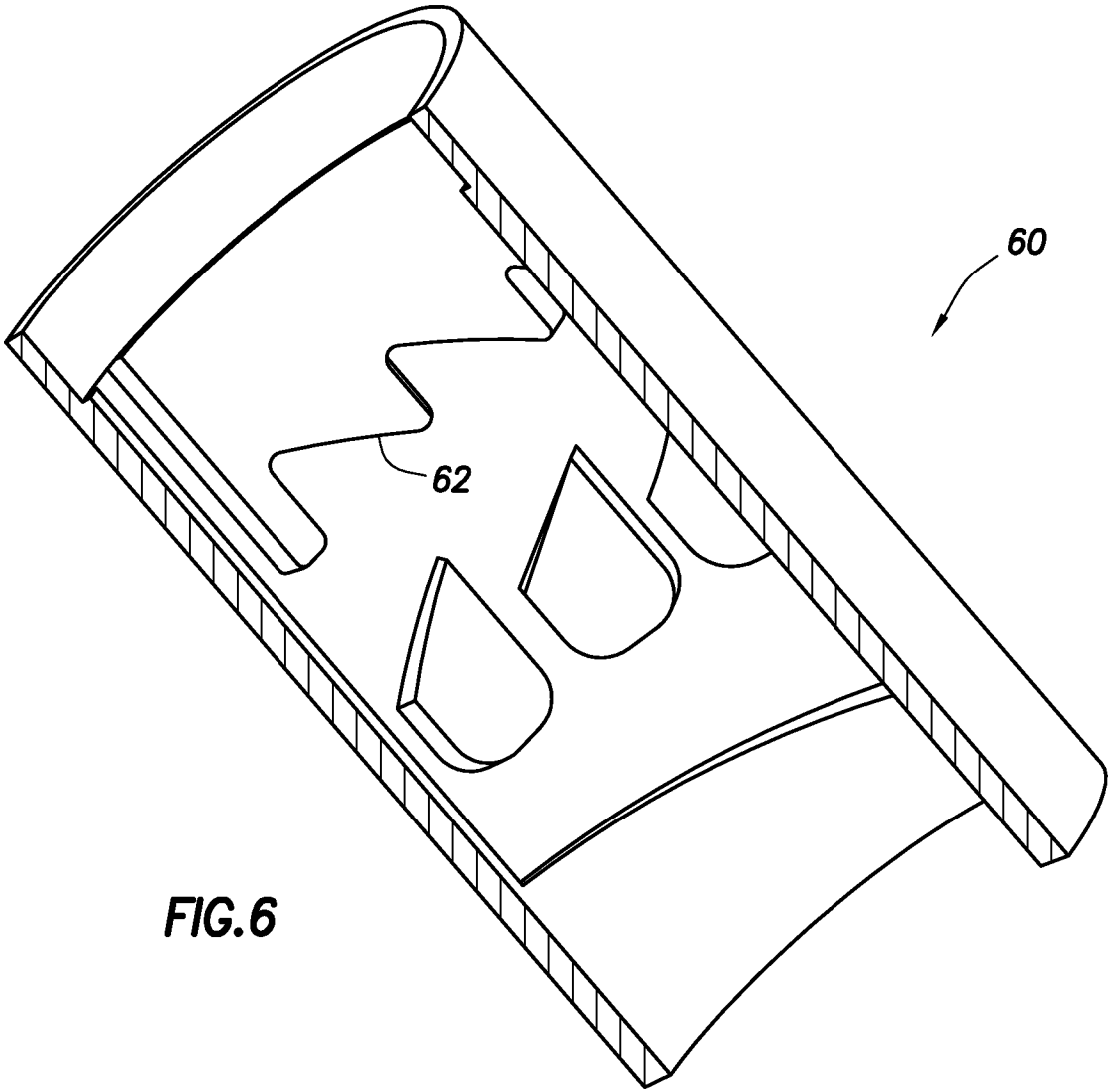
FIG. 6 is a representative isometric and cross-sectional view of a J-slot sleeve which may be used in a valve in the completion string.

However, in other examples (such as that depicted in FIG. 6), the J-slot profile 62 may not extend completely radially through the sleeve 60.

The combination of the J-slot sleeve 60 and the sleeve 56 having the lug 58 engaged with the J-slot profile 62 comprises a ratchet mechanism 64 which can be used to control relative displacement between the piston 48 and the closure member 42.

In this example, the J-slot sleeve 60 is retained rigidly in the housing assembly 44. The sleeve 56 with the lug 58 engages the J-slot profile 62 and can displace both axially and rotationally as the piston 48 displaces. In other examples, the sleeve 60 could be rotationally mounted, and the sleeve 56 could be prevented from rotating, the sleeve 56 could be external to the sleeve 60, etc.

In the FIG. 2 configuration, pressures in the annulus 28 and passage 40 are either balanced, or the pressure in the passage is not sufficiently increased (relative to the annulus pressure) to displace the piston 48 leftward. This would typically be the configuration in which the valve 36 is installed.

Figure 3:
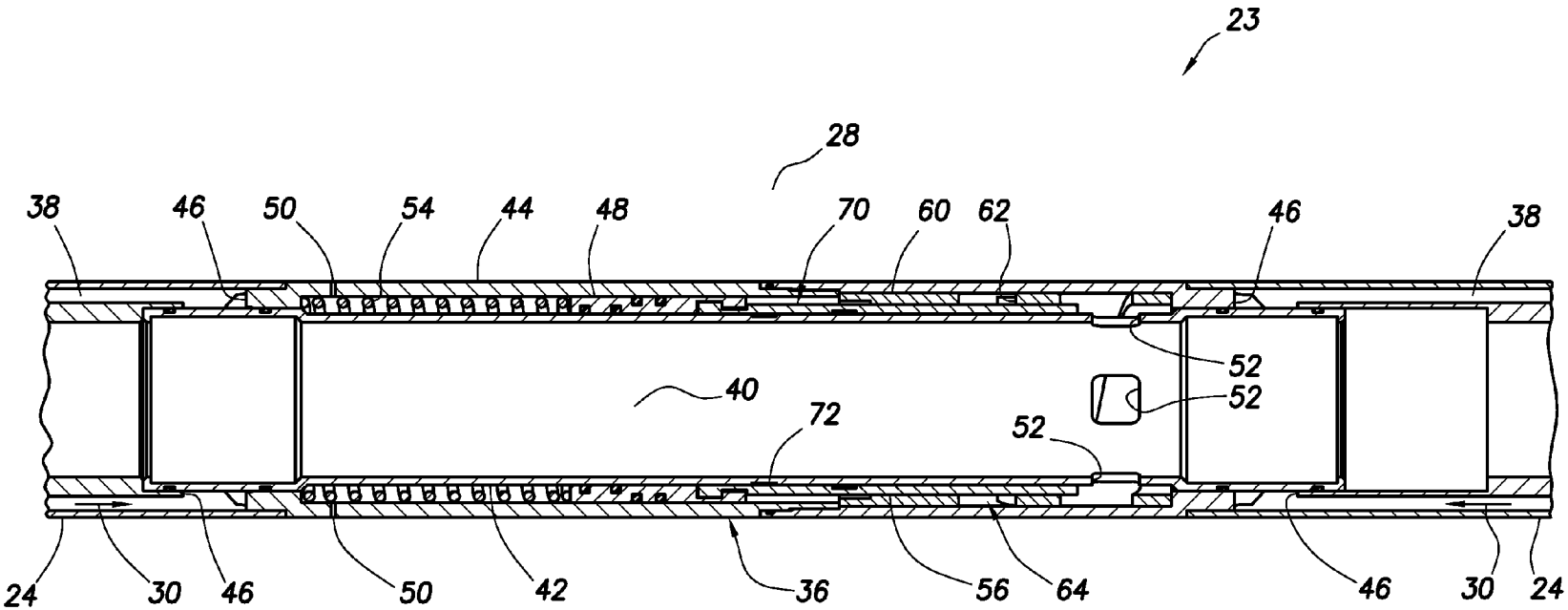

In FIG. 3, the valve 36 is depicted after a sufficient pressure increase has been applied to the passage 40 to cause the piston 48 and sleeve 56 to displace leftward somewhat. Note that the closure member 42 has not displaced, due to the fact that, in this configuration, relative displacement between the piston 48 and the closure member is permitted.

Within a range of pressures applied to the passage 40 (e.g., between about 1000 psi (~7 MPa) and about 3000 psi (~21 MPa)), the piston 48 and sleeve 56 can displace back and forth without causing the valve 36 to actuate to its open configuration. Of course, the specific pressures used can be changed as desired to suit a particular set of conditions.

This back and forth displacement of the piston 48 and sleeve 56 can occur during the installation and fracturing/gravel packing operations described above, without causing the valve 36 to open. As the sleeve 56 displaces back and forth, the lug 58 traverses the J-slot profile 62, causing the sleeve to at times rotate relative to the piston 48.

Figure 7:
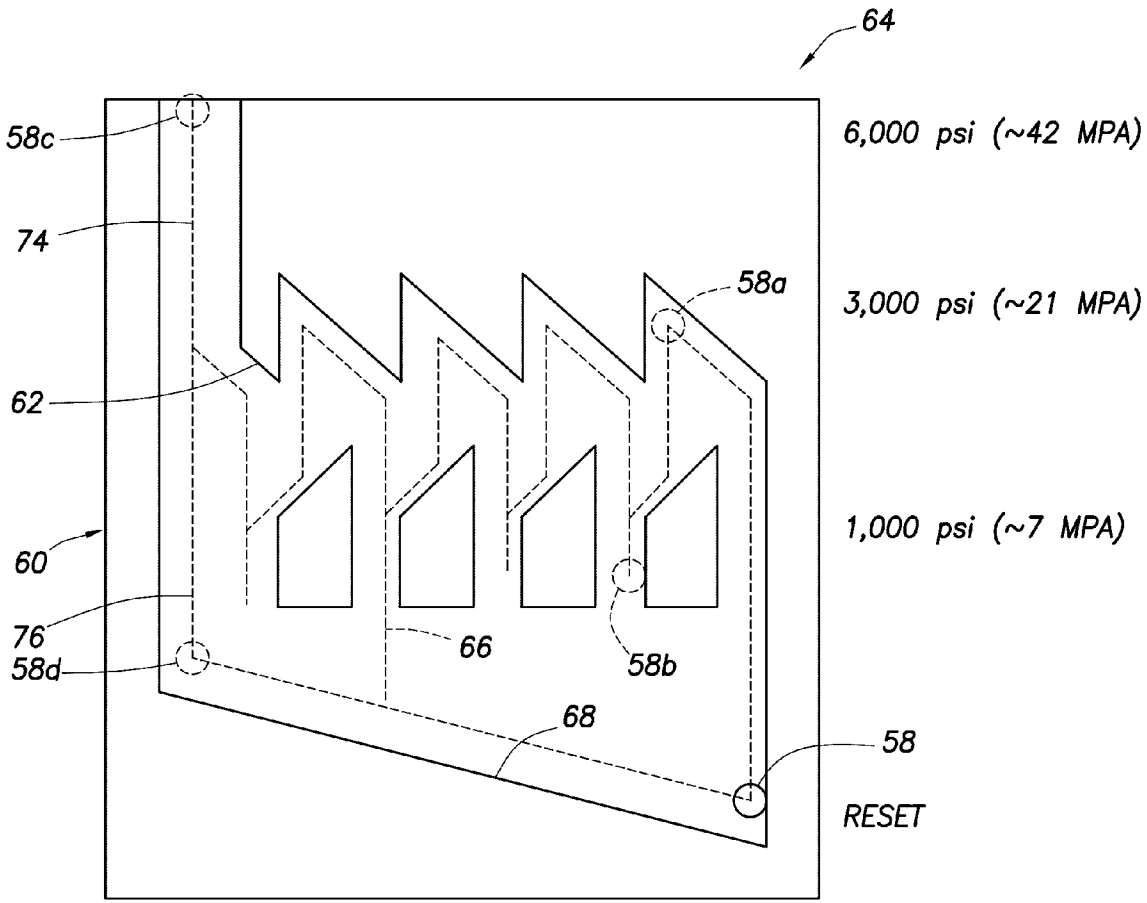
FIG. 7 is a representative "unrolled" view of the J-slot sleeve, illustrating paths of a lug through a J-slot profile on the sleeve.

Referring now to FIG. 7, the sleeve 60 is depicted as if it is "unrolled," thereby making the profile 62 more clearly visible. The lug 58 is illustrated in its initial FIG. 2 position, with dashed lines indicating a possible path of the lug as it traverses the profile 62.

When pressure in the passage 40 is increased to about 3000 psi greater than pressure in the annulus 28, the lug 58 will displace to position 58*a* as depicted in FIG. 3. If pressure in the passage 40 is then decreased to about 1000 psi greater than pressure in the annulus 28, the lug 58 will displace to position 58*b*.

A series of such pressure increases and decreases (pressure cycles) can be applied, causing the lug 58 to repeatedly displace back and forth relative to the J-slot profile 62 as indicated in FIG. 7. The shape of the profile 62 is such that the lug 58 and sleeve 56 will be caused to incrementally rotate relative to the J-slot sleeve 60 each time the pressure is increased or decreased in the example depicted in FIG. 7.

In this manner, a certain number of such pressure cycles can be accommodated by the ratchet mechanism 64, without causing actuation of the valve 36. This allows the installation and fracturing/gravel packing operations described above to be accomplished while the valve 36 remains closed.

At any point, however, pressure in the passage 40 can be sufficiently decreased so that the piston 48 is displaced back to its FIG. 2 position, thereby causing the lug 58 to return to its initial position as depicted in FIG. 7. An example of such a pressure reduction is indicated in FIG. 7 by a dashed line representing a reset path 66 following a third pressure cycle.

However, it should be clearly understood that the ratchet mechanism 64 can be reset at any time (e.g., after any number of pressure cycles) by sufficiently reducing the pressure applied to the passage 40. This reduction in pressure causes the lug 58 to engage an inclined ramp 68 which biases the lug back to its initial position.

It will be appreciated that this is a particular benefit of the design of the valve 36. The valve 36 can be reset back to its initial configuration at any time, and after any number of pressure cycles have been applied.

Thus, when it is desired to open the valves 36 in the system 10, pressure in the interior of the tubular string 22 can be sufficiently reduced, so that the lugs 58 in the valves return to their initial positions. In this manner, the valves 36 are all returned to a known configuration, from which further pressure manipulations can be applied to cause the valves to open.

Note that, although four pressure cycles are provided for in the examples described herein, any number of pressure cycles can be accommodated by appropriately configuring the profile 62. As far as the reset path 66 is concerned, any number of pressure cycles can precede the reset path. The actuator 70 can be reset any number of times during or after the installation and fracturing/gravel packing operations.

Figure 4:
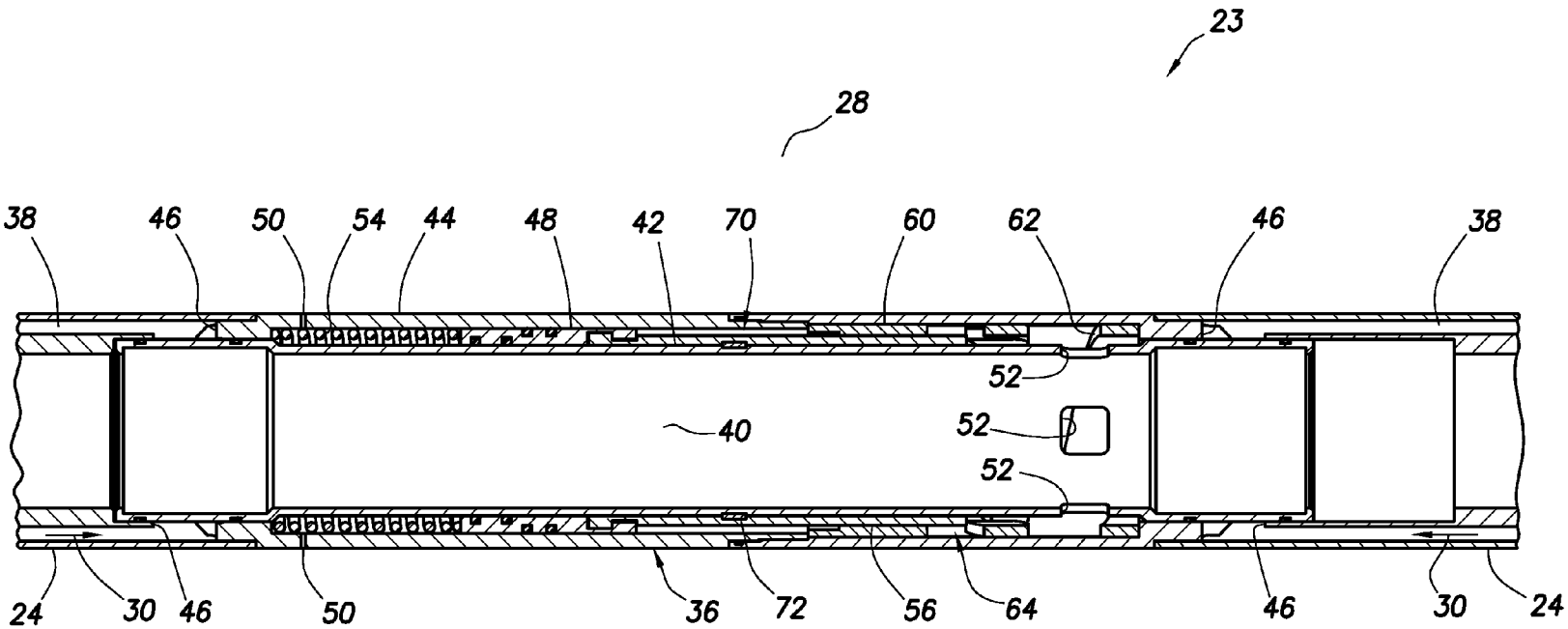

In FIG. 4, the valve 36 is depicted after the actuator 70 has been reset, then a predetermined number of pressure cycles have been applied (four pressure cycles in this example), and then a sufficient increased pressure has been applied to displace the piston 48 fully leftward and engage a locking device 72. The resulting path of the lug 58 through the J-slot profile 62 is indicated in FIG. 7 as a locking path 74 to a locked position 58*c*.

In this position, the locking device 72 prevents relative displacement between the piston 48 and the closure member 42. In further operation of the valve 36, the closure member 42 displaces with the piston 48 and sleeve 56.

In this example, the locking device comprises a C-shaped snap ring carried in a groove on the closure member 42. In the locked position, the ring engages another groove formed in the sleeve 56. However, other types of locking devices (e.g., dogs, lugs, balls, collets, etc.) may be used, if desired.

Figure 5:
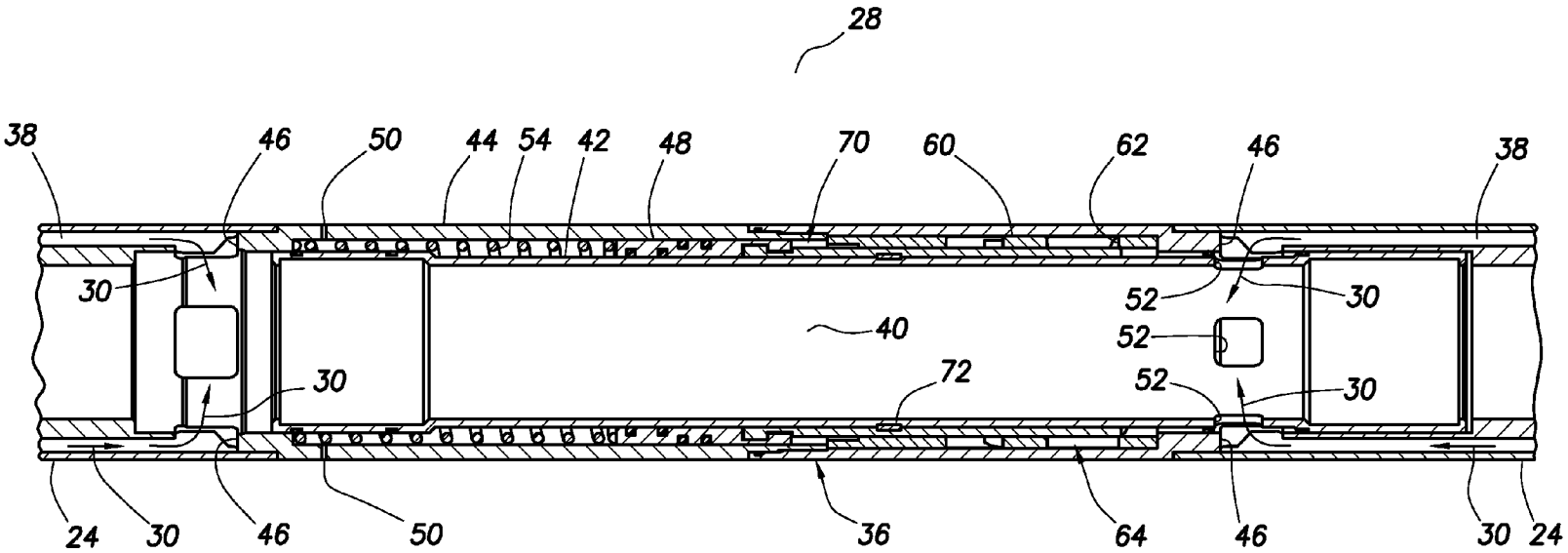

In FIG. 5, the valve 36 is depicted after pressure in the passage 40 has been reduced, and the piston 48 has thus displaced rightward. Since the closure member 42 now displaces with the piston 48, the closure member has also displaced rightward as viewed in FIG. 5. The resulting path of the lug 58 through the J-slot profile 62 is indicated in FIG. 7 as an actuation path 76 to an actuated position 58*d*.

Due to the displacement of the closure member 42 with the piston 48, the ports 46 are no longer blocked, and the fluid 30 can now flow inwardly through the ports into the passage 40. If multiple valves 36 are installed in the completion string 23 as depicted in FIG. 1, all of the valves can be opened simultaneously in response to the pressure reduction which follows the actuator 70 being reset and the predetermined number of pressure cycles being applied, as described above.

Figure 8:
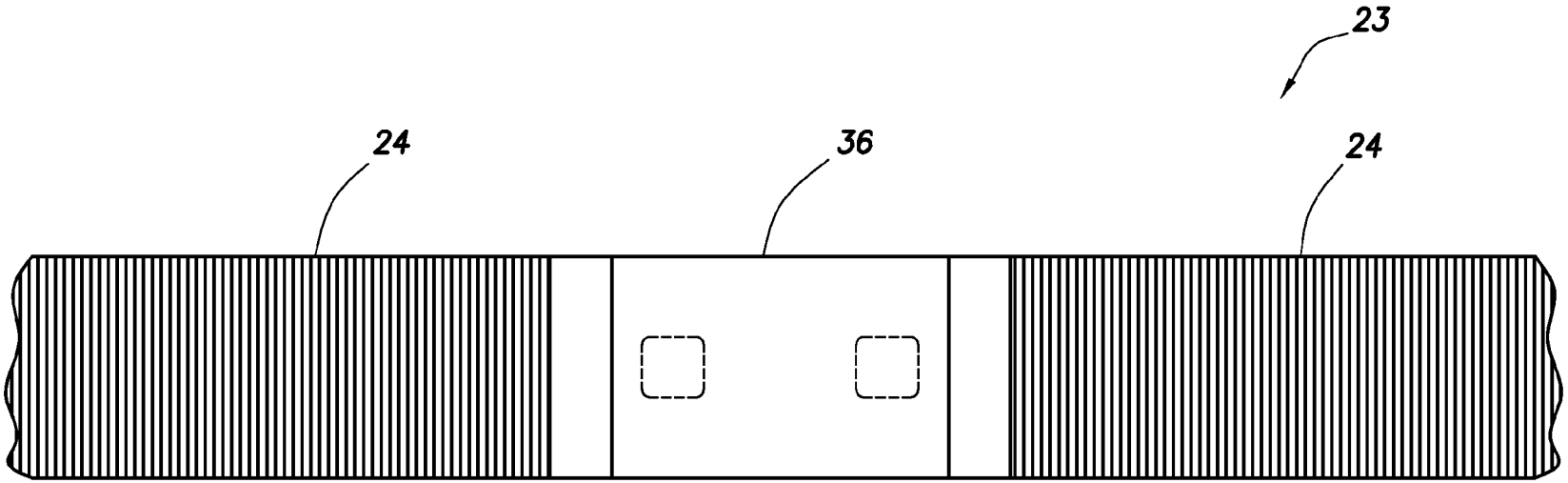
FIG. 8 is a representative side view of the section of the completion string.

In FIG. 8, the valve 36 is depicted as being interconnected between two well screens 24 as in the examples of FIGS. 2-5 described above. However, in other examples, the valve 36 is not necessarily connected between two well screens 24, and the valve can control flow through any other number of well screens, or can otherwise control flow between the interior and the exterior of the completion string 23, in keeping with the principles of this disclosure.

It may now be fully appreciated that this disclosure provides a number of improvements to the art. The valve 36 includes an actuator 70 which can be reset after a number of pressure differential cycles have been applied, for example, during installation, fracturing/gravel packing and/or other operations. After resetting the actuator 70, the valve 36 can be actuated by applying a predetermined number of pressure differential cycles, followed by increasing the applied pressure differential, and then decreasing the applied pressure differential.

The above disclosure provides to the art a method of actuating multiple valves 36 in a well. The method can include applying at least one pressure cycle to the valves 36 without causing actuation of any of the valves 36; and then reducing pressure applied to the valves 36, thereby resetting a pressure cycle-responsive actuator 70 of each valve 36.

Reducing pressure applied to the valves 36 may include reducing the pressure to a first predetermined pressure which is less than any pressure applied in the previous pressure cycle(s).

The method can also include the step of, after reducing pressure applied to the valves 36, applying a predetermined number of pressure cycles to the valves 36. The method can also include the step of, after applying the predetermined number of pressure cycles to the valves 36, increasing pressure applied to the valves 36.

The increasing pressure step can include increasing pressure to a second predetermined pressure which is greater than any pressure applied in the pressure cycle(s).

The increasing pressure step can include engaging a locking device 72, thereby causing the closure member 42 to displace when a piston 48 displaces.

The method can include a step of reducing pressure applied to the valves 36 after increasing pressure applied to the valves 36, thereby actuating all of the valves 36.

The reducing pressure step can include reducing pressure to a predetermined pressure which is less than any pressure applied in the pressure cycle(s).

The valves 36 may be interconnected in a tubular string 23, and the valves 36 may selectively permit and prevent flow between an interior and an exterior of the tubular string 23.

Applying the pressure cycle(s) can include applying pressure differentials between the interior and the exterior of the tubular string 23.

At least one of the valves 36 may selectively control flow through multiple well screens 24.

Resetting the pressure cycle-responsive actuator 70 may include displacing a lug 58 relative to a J-slot profile 62, thereby returning the lug 58 to an initial position relative to the J-slot profile 62.

Also described by the above disclosure is a pressure cycle-operated valve 36 for use with a subterranean well. The valve 36 may include a closure member 42, a piston 48 which displaces in response to pressure applied to the valve 36, and a ratchet mechanism 64 which controls relative displacement between the piston 48 and the closure member 42. The ratchet mechanism 64 permits relative displacement between the piston 48 and the closure member 42 while at least one pressure cycle is applied to the valve 36. The ratchet mechanism 64 prevents relative displacement between the piston 48 and the closure member 42 in response to a pressure sequence of: a) a first reduction in pressure applied to the valve 36, b) a predetermined number of pressure cycles applied to the valve 36, and c) an increase in pressure applied to the valve 36.

The valve 36 can actuate in response to a second reduction in pressure applied to the valve 36 after the increase in pressure applied to the valve 36.

The first reduction in pressure applied to the valve 36 may reset the ratchet mechanism 64.

The first reduction in pressure applied to the valve 36 may include a reduction to a first predetermined pressure which is less than any pressure applied in the pressure cycle(s).

The increase in pressure applied to the valve 36 may include an increase to a second predetermined pressure which is greater than any pressure applied in the pressure cycle(s).

A locking device 72 may engage in response to the pressure sequence, thereby preventing relative displacement between the closure member 42 and the piston 48.

The pressure sequence can comprise a series of pressure differentials between an interior and an exterior of the valve 36.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A pressure cycle-operated valve for use with a subterranean well, the valve comprising:

a closure member;

a piston which displaces in response to pressure applied to the valve; and a ratchet mechanism which controls relative displacement between the piston and the closure member, whereby relative displacement between the piston and the closure member is permitted while at least one pressure cycle is applied to the valve, and relative displacement between the piston and the closure member is prevented in response to a pressure sequence of: a) a first reduction in pressure applied to the valve, b) a predetermined number of pressure cycles applied to the valve, and c) an increase in pressure applied to the valve.

2. The valve of claim 1, wherein the valve actuates in response to a second reduction in pressure applied to the valve after the increase in pressure applied to the valve.

3. The valve of claim 1, wherein the first reduction in pressure applied to the valve resets the ratchet mechanism.

4. The valve of claim 1, wherein the first reduction in pressure applied to the valve further comprises a reduction to a first predetermined pressure which is less than any pressure applied in the at least one pressure cycle.

5. The valve of claim 1, wherein the increase in pressure applied to the valve further comprises an increase to a second predetermined pressure which is greater than any pressure applied in the at least one pressure cycle.

6. The valve of claim 1, wherein a locking device engages in response to the pressure sequence, thereby preventing relative displacement between the closure member and the piston.

7. The valve of claim 1, wherein the pressure sequence comprises a series of pressure differentials between an interior and an exterior of the valve.

8. The valve of claim 1, wherein the valve selectively controls flow through multiple well screens.

9. The valve of claim 1, wherein the ratchet mechanism comprises a lug which displaces relative to a J-slot profile, and wherein the lug returns to an initial position relative to the J-slot profile in response to the first reduction in pressure applied to the valve.

* * * * *